US007516578B2

(12) United States Patent
Bonshor

(10) Patent No.: US 7,516,578 B2
(45) Date of Patent: Apr. 14, 2009

(54) EXTERIOR SIDING MOUNTING BRACKETS WITH A WATER DIVERSION DEVICE

(75) Inventor: Dave Bonshor, Surrey (CA)

(73) Assignee: Tapco International Corporation, Wixom, MI (US)

( * ) Notice: Subject to any disclaimer, the term of this patent is extended or adjusted under 35 U.S.C. 154(b) by 221 days.

(21) Appl. No.: 11/438,165

(22) Filed: May 22, 2006

(65) Prior Publication Data

US 2006/0260216 A1 Nov. 23, 2006

Related U.S. Application Data

(60) Provisional application No. 60/682,692, filed on May 20, 2005.

(51) Int. Cl.
*E04D 13/00* (2006.01)

(52) U.S. Cl. ..... 52/97; 52/60; 52/61; 52/302.1; 248/205.1; 248/906

(58) Field of Classification Search ..... 52/60, 52/61, 97, 204.54, 209, 220.8, 302.1; 248/205.1, 248/906

See application file for complete search history.

(56) References Cited

U.S. PATENT DOCUMENTS

| | | | | |
|---|---|---|---|---|
| 4,920,708 | A | 5/1990 | MacLeod et al. | |
| 5,133,165 | A * | 7/1992 | Wimberly | 52/220.8 |
| 5,326,060 | A * | 7/1994 | Chubb et al. | 248/231.9 |
| 5,397,093 | A * | 3/1995 | Chubb et al. | 248/544 |
| 5,549,266 | A * | 8/1996 | Mitchell et al. | 248/205.1 |
| 6,070,375 | A * | 6/2000 | Anderson et al. | 52/204.54 |
| 6,076,310 | A * | 6/2000 | Kim | 52/97 |
| 6,429,371 | B2 * | 8/2002 | Schiedegger et al. | 174/50 |
| 6,553,735 | B1 * | 4/2003 | Wang Chen | 52/455 |
| 6,825,414 | B2 * | 11/2004 | Vagedes | 174/58 |
| 6,904,725 | B1 * | 6/2005 | Hansen et al. | 52/200 |
| 2003/0041539 | A1 * | 3/2003 | Bernacki et al. | 52/204.54 |
| 2003/0136060 | A1 * | 7/2003 | Bonshor | 52/97 |
| 2007/0175168 | A1 * | 8/2007 | Bonshor | 52/729.1 |

* cited by examiner

*Primary Examiner*—Brian E. Glessner
*Assistant Examiner*—James J Buckle, Jr.
(74) *Attorney, Agent, or Firm*—Howard & Howard Attorneys P.L.L.C.

(57) ABSTRACT

An exterior siding mounting bracket used in conjunction with siding placed over sheathing of an exterior wall has a base member having a base flange fastened to the sheathing. A wall arrangement projects laterally outward from the base flange and away from the sheathing. A trim member of the bracket has a partition arrangement that preferably snap fits to the wall arrangement and a trim flange constructed and arranged to cover cut edges of the siding that cover in-part the base flange. Integrated at least into the trim member is a water diversion device that diverts water away from the base flange and sheathing. Preferably, the water diversion device has an elongated trough supported by the trim member and projecting laterally inward from the trim flange and toward the base flange and above the wall and partition arrangements. The trough preferably has a face that defines a channel opened upwardly for receipt of the falling water and a hole communicating through the face for drainage of the water out of the water out of the trough.

15 Claims, 5 Drawing Sheets

EXTERIOR SIDING MOUNTING BRACKETS WITH A WATER DIVERSION DEVICE

RELATED APPLICATIONS

This patent application claims priority to and all advantages of U.S. Provisional Patent Application No. 60/682,692 which was filed on May 20, 2005.

FIELD OF THE INVENTION

The subject invention generally relates to exterior siding mounting brackets and more particularly to exterior siding mounting brackets having an integrated water diversion device.

BACKGROUND OF THE INVENTION

Especially common in residential building structures, exterior walls or underlayment are known to be covered with a siding material typically made of aluminum, plastic, cedar or other synthetic material often made to appear like wood. Often, various exterior appendages of the home such as drying vents, exterior light fixtures, electrical outlets, and water spigots must be trimmed-out for aesthetic reasons. This is commonly done with a mounting bracket similar to that illustrated in FIG. 1 as prior art and disclosed in U.S. Pat. No. 4,920,708 and incorporated herein by reference in it's entirety. The known bracket 20 has a base member 22 that snap fits to a trim member 24 along an axis 26 disposed perpendicular to the underlayment and during assembly. The base member 22 has a continuous flange 28 that projects radially outward and is typically nailed to the underlayment. Projecting axially or laterally outward from the flange 28 and to an inner central panel 30 is a continuous wall 32. Generally, the wall 32 defines the perimeter of the central panel 30. A cutout 34 communicates through the panel 30 and has a shape generally dictated by the appendage projecting through it (not shown).

The trim member 24 has a continuous partition 36 that projects laterally and axially inward toward the base member 22, and a aesthetically pleasing flange 38 that projects radially outward from the partition 36. An opening 39 is generally defined by the partition 36 and receives the wall 32 and panel 30 when the bracket 20 is assembled. The partition 36 is generally shaped to conform with the wall 32. Multi-positional snap fit features (not shown) are known to be carried between a radially outward surface 40 of the wall 32 and a radially inward surface 42 of the partition 36. When the bracket is assembled, the close proximity of the partition 36 to the wall 32 causes the feature to lock the partition and wall together.

During construction of the building, once the base member 22 is secured to the wall, the siding material is installed over the wall and over the flange 28. The siding, however, must be trimmed so that it is slightly spaced from the continuous wall 32 of the base member 22. This spacing allows room for entry of the continuous partition 36 of the trim piece 24, yet is close enough to the wall so that the ends are aesthetically concealed by the outer flange 38 of the trim member 24 which is substantially flush to the siding. Unfortunately, the siding is typically exposed to rain or water which flows down the siding and beneath the exterior flange 38. This water can accumulate and seep into the concealed ends of the siding and seep further to down the inner flange 28 of the base member 22 exposing the underlayment to moisture. This retain moisture can potentially create a host of problems including the rot of wood, disintegration of simulated materials and the attraction of unwanted insects.

SUMMARY OF THE INVENTION AND ADVANTAGES

An exterior siding mounting bracket used in conjunction with siding placed over sheathing of an exterior wall has a base member having a base flange fastened to the sheathing. A wall arrangement projects laterally outward from the base flange, away from the sheathing and surrounds a cutout for protrusions of the exterior wall. A trim member of the bracket has a partition arrangement that preferably defines an opening and snap fits to the wall arrangement and a trim flange constructed and arranged to cover cut edges of the siding that cover in-part the base flange. Integrated at least into the trim member is a water diversion device that diverts water away from the base flange and sheathing. Preferably, the water diversion device has an elongated trough supported by the trim member and projecting laterally inward from the trim flange and toward the base flange and above the wall and partition arrangements. The trough preferably has a face that defines a channel opened upwardly for receipt of the falling water and a hole communicating through the face for drainage of the water out of the water out of the trough.

Preferably, the water diversion device also has a cantilevered eave disposed above the trough and engaged to the base flange. In a second embodiment, the eave is replaced with a resiliently flexible lip of the trough that seals against the base flange when the bracket is fully assembled. In a third embodiment, the hole communicates through a bottom segment of the trough and with a passage defined by a tube. The tube is engaged to the bottom segment and extends downward, preferably through a bottom portion of the trim flange and to an open distal end located over the siding located generally below the bracket.

Features, advantages and benefits of the present invention include a mounting bracket with improved water shedding capabilities that eliminates the potential of sheathing from being exposed to moisture which could cause damage to structural material and potentially attract unwanted insects. Other advantages include the reduction or elimination of structural maintenance, a bracket design that is relatively simple and robust, and a bracket that is inexpensive to manufacture and easy to install.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 17:
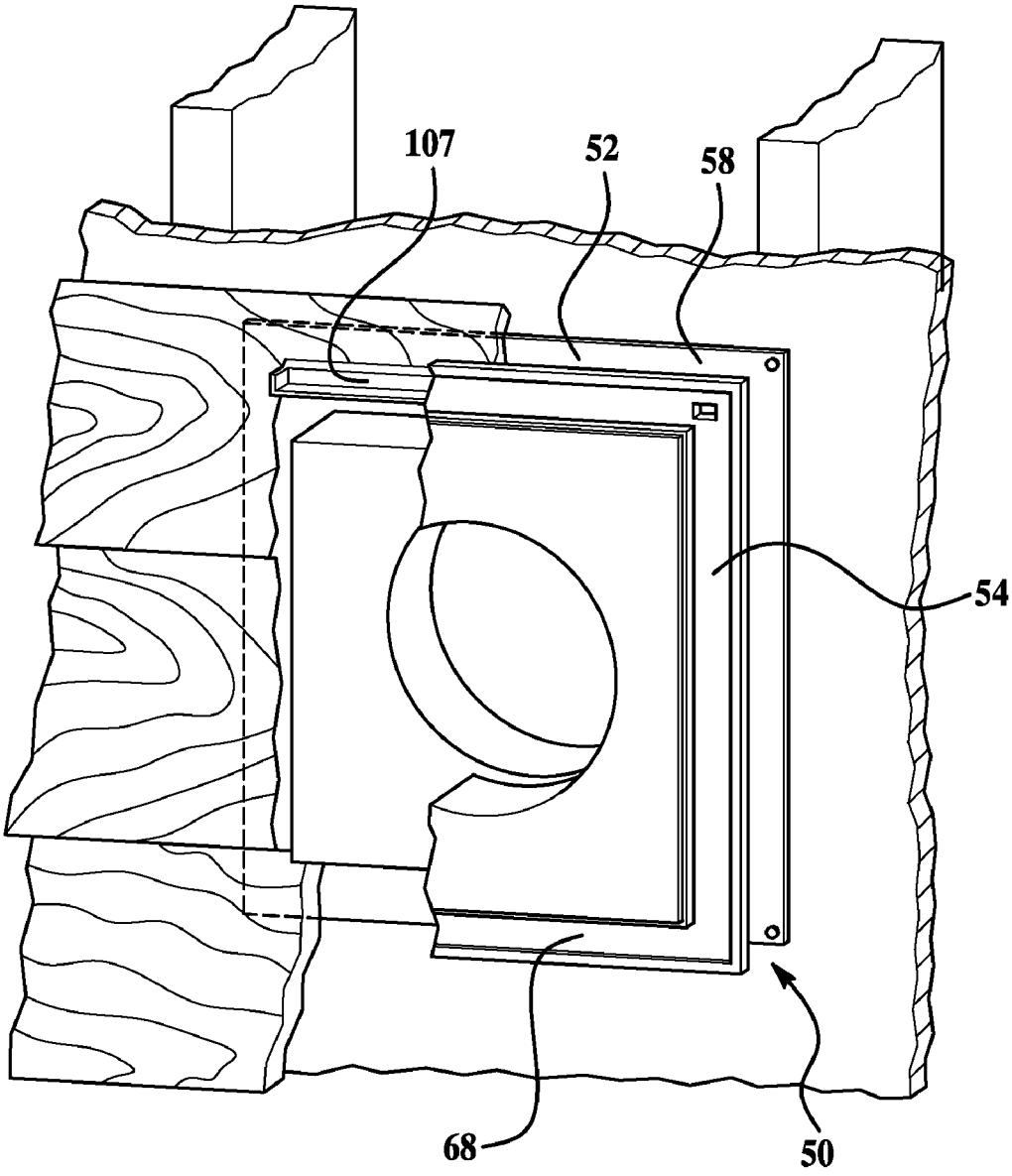
FIG. 17 is a cut-away environmental view of the mounting bracket.

As best illustrated in FIGS. 2-8, a mounting bracket 50 embodying the present invention that preferably fastens to a substructure of an exterior wall is a substantially vertical orientation. The substructure is generally an underlayment or sheathing that is preferably covered with a siding material as shown in FIG. 17. The mounting bracket 50 has a base member 52 that snap fits to a trim member 54 along an axis 56 preferably disposed substantially perpendicular to the underlayment and during assembly. The base member 52 has continuous flange 58 and a preferably continuous wall arrangement 62 (see FIG. 3). The flange 58 projects radially outward from the wall arrangement 62 and is typically nailed to the underlayment. The wall arrangement 62 projects axially or laterally outward from the flange 58 and preferably to an inner central panel 60 spaced from and orientated substantially parallel to the underlayment. Generally, the wall arrangement 62 defines or carries a perimeter 63 of the central panel 60. A cutout 64 communicates through the panel 32 and has a shape generally dictated by the appendage projecting through it (not shown).

The trim member 54 preferably has a continuous partition arrangement 66 that projects laterally and/or axially inward toward the base member 52, and an aesthetically pleasing flange 68 that projects radially outward from the partition arrangement 66. The partition arrangement 66 is generally shaped to conform with the wall arrangement 62. Multi-positional snap fit features (not shown) are preferably carried between a radially outward surface 70 of the wall arrangement 62 and a radially inward surface 72 of the partition arrangement 66. When the bracket 50 is assembled, the close proximity of the partition arrangement 66 to the wall arrangement 62 causes the feature to lock the partition and wall arrangements together at an axial orientation generally dictated by the thickness of the siding.

Figure 3:
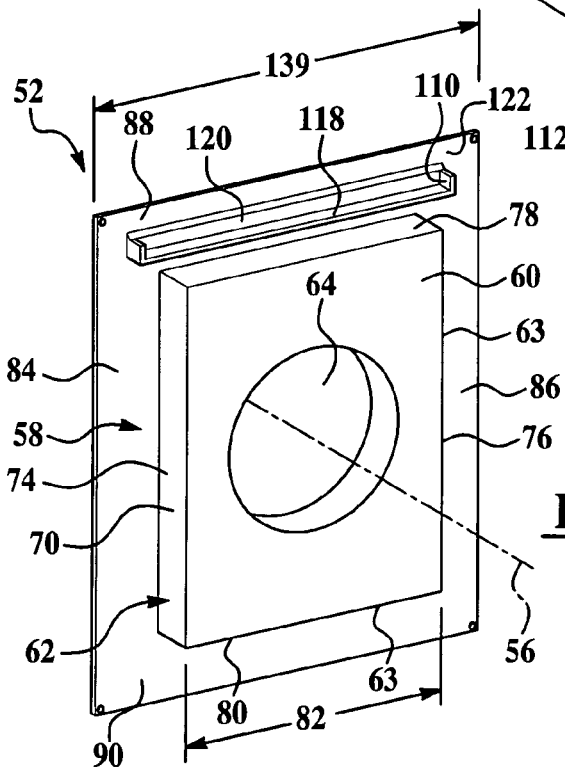
FIG. 3 is a perspective front view of a base member of the mounting bracket of the present invention.

Referring to FIG. 3, preferably the wall arrangement 62 of the base member 52 forms a rectangular or square shape having a left side wall 74, a right side wall 76, a top wall 78 and a bottom wall 80. The side wall 74, 76 are substantially vertical and the top and bottom wall 78, 80 are substantially horizontal. The top wall 78 extends longitudinally between top ends of respective left and right side walls 74, 76 thus having a longitudinal length that is generally equal to a spatial distance 82 measured between the side walls 74, 76. Similarly, the flange 58 of the base member 52 has a left portion 84 associated with the left side wall 74, a right portion 86 associated with the right side wall 76, a top portion 88 associated with the top wall 78, and preferably a bottom portion 90 associated with the bottom wall 80. One skilled in the art, however, would now realize that the continuous wall arrangement 62 may take the form of any shape including but not limited to that of a circle, oval, octagon and hexagon.

Figure 4:
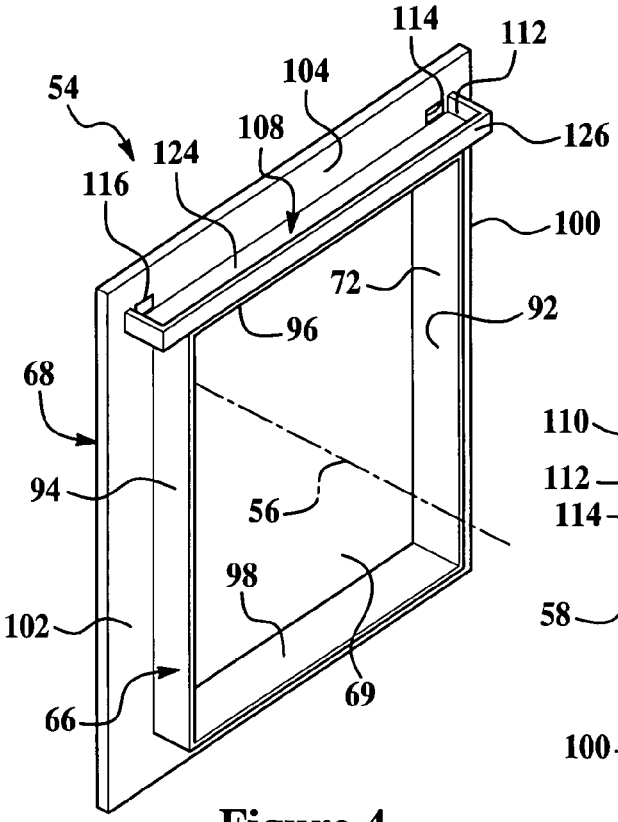
FIG. 4 is a perspective rear view of a trim member of the mounting bracket.
Figure 5:
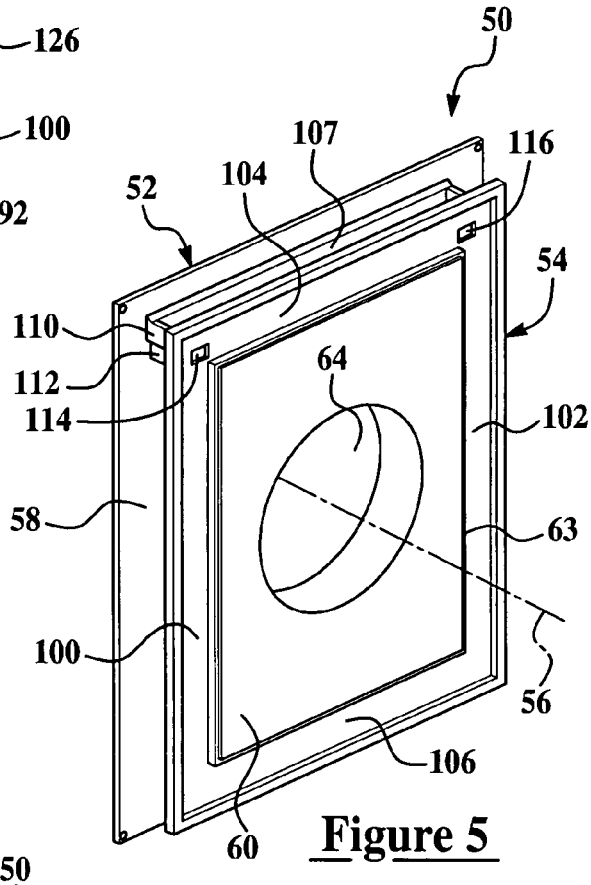
FIG. 5 is a perspective rear view of the mounting bracket.
Figure 6:
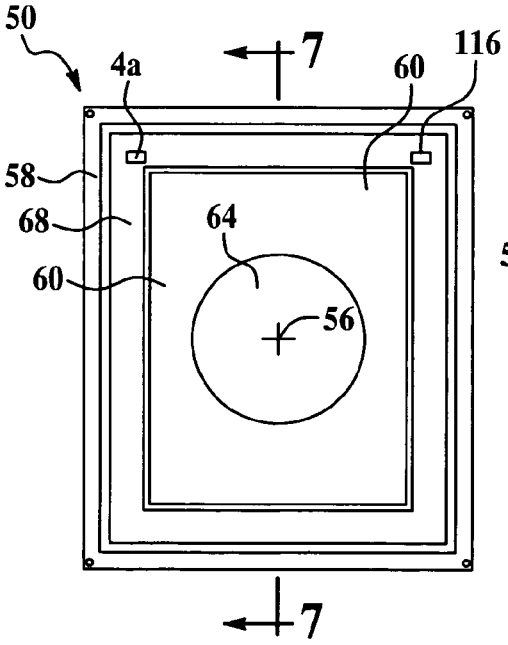
FIG. 6 is a front view of the mounting bracket.
Figure 7:
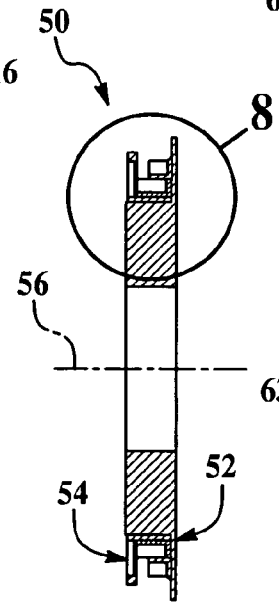
FIG. 7 is a cross section of the mounting bracket taken along line 7-7 of FIG. 6.
Figure 8:
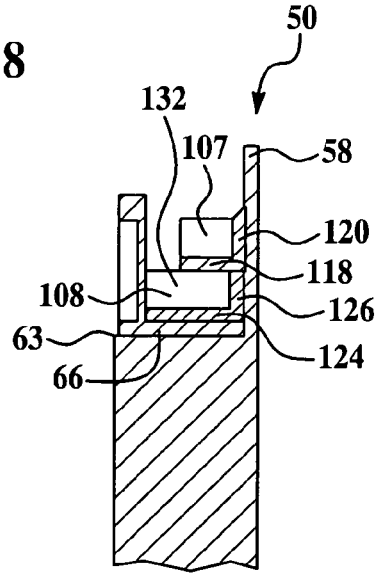
FIG. 8 is a partial enlarged cross section of the mounting bracket taken from circle 8 of FIG. 7.
Figure 9:
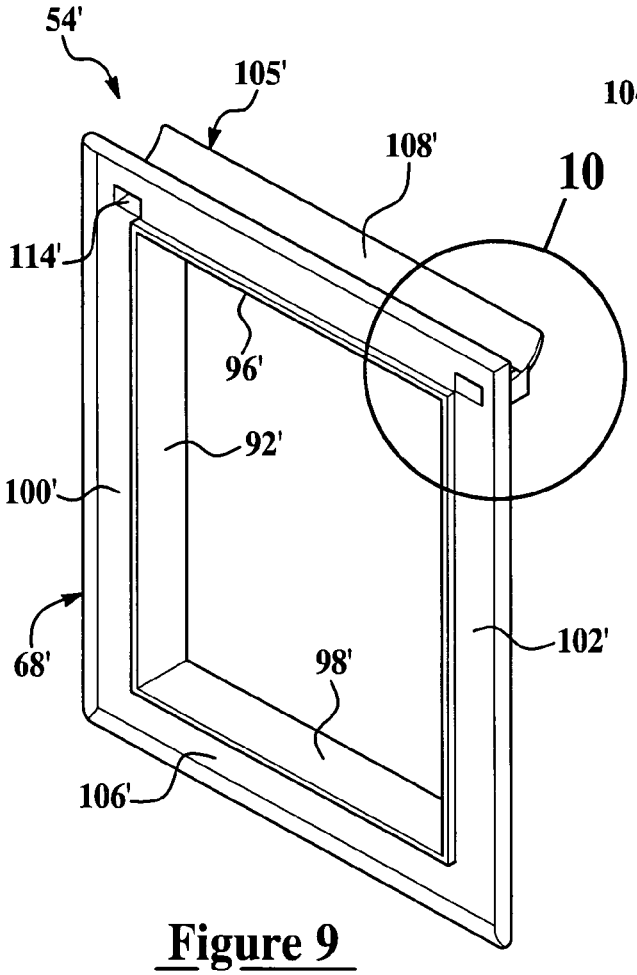
FIG. 9 is a perspective front view of a second embodiment of a trim member of a mounting bracket.
Figure 10:
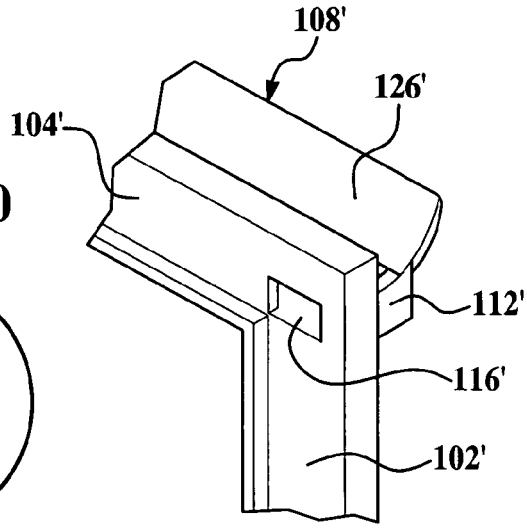
FIG. 10 is a partial enlarged cross section of the trim member taken from circle 10 of FIG. 9.
Figure 11:
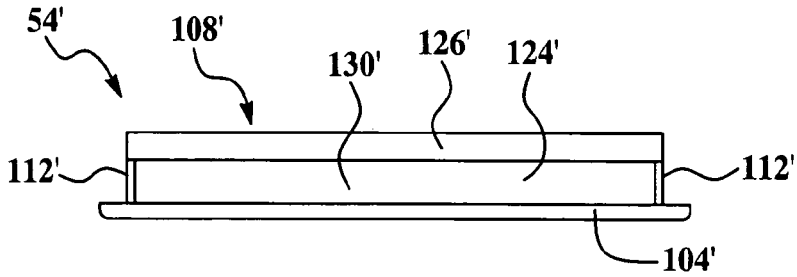
FIG. 11 is top view of the trim member of the second embodiment.
Figure 12:
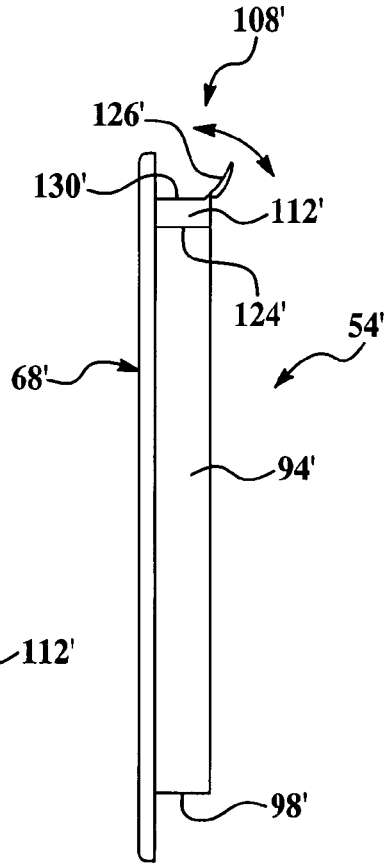
FIG. 12 is a side view of the trim member of the second embodiment.
Figure 13:
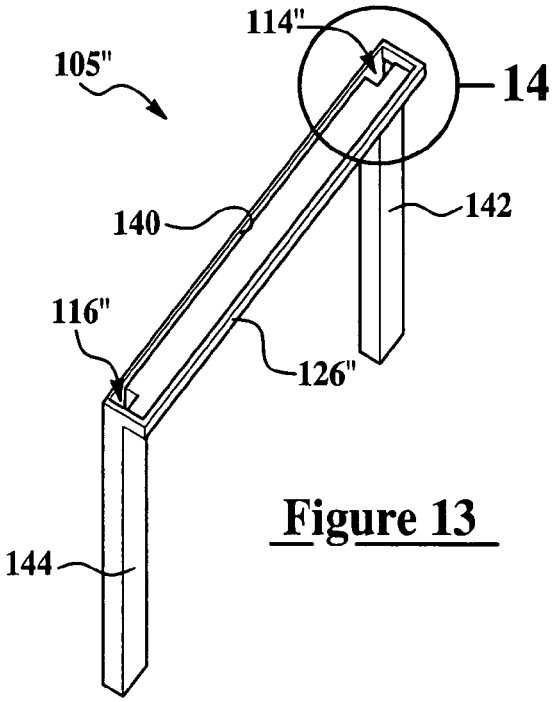
FIG. 13 is a perspective view of a water diversion device of a third embodiment of a mounting bracket.
Figure 14:
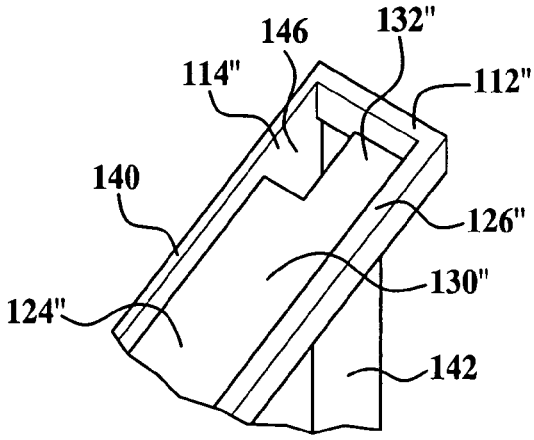
FIG. 14 is a partial enlarged perspective view of the water diversion device taken from circle 14 of FIG. 13.
Figure 15:
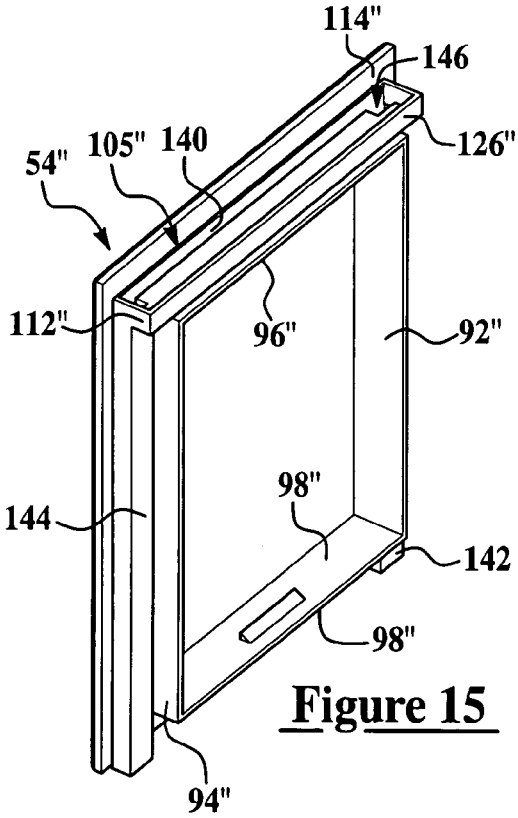
FIG. 15 is perspective rear view of the third embodiment with a base member removed to show internal detail.
Figure 16:
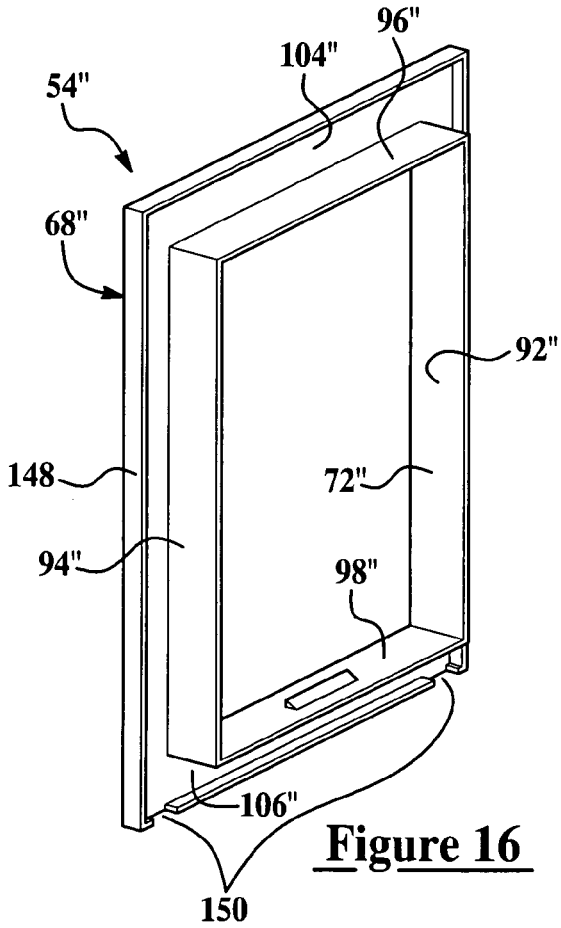
FIG. 16 is a perspective rear view of a trim member of the third embodiment.

Referring to FIG. 4, preferably the partition arrangement 66 of the trim member 54 conforms in shape to the wall arrangement 62, thus preferably having a left side partition 92, a right side partition 94, a top partition 96 and a bottom partition 98. The side partitions 92, 94 are substantially vertical and the top and bottom partitions 96, 98 are substantially horizontal. Similarly, the flange 68 of the trim member 54 has a left portion 100 associated with the left side partition 92, a right portion 102 associated with the right side partition 94, a top portion 104 associated with the top partition 96, and preferably a bottom portion 106 associated with the bottom partition 98.

Figure 1:
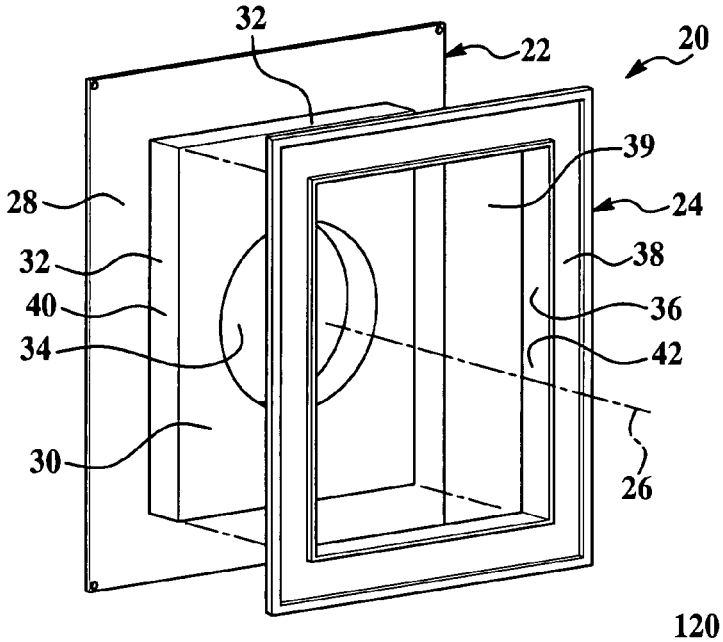
Figure 1 Prior Art
FIG. 1 is an exploded perspective view of a prior art mounting bracket.
Figure 2:
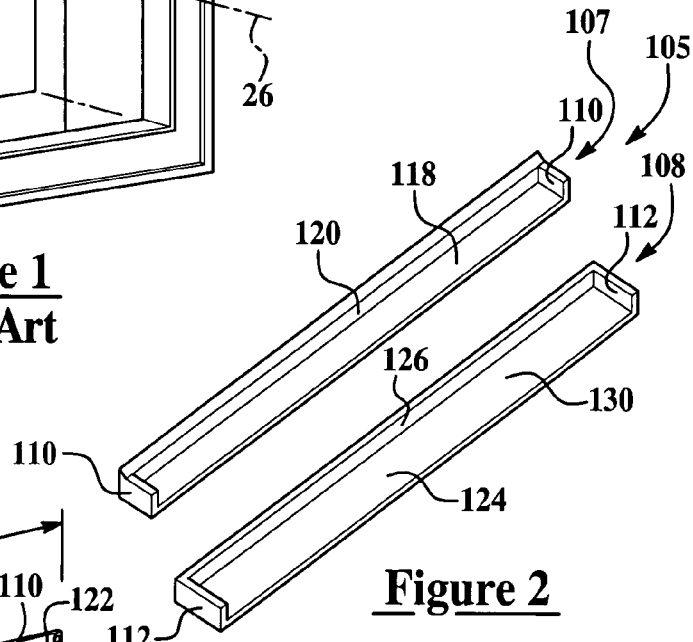
FIG. 2 is an exploded perspective view of a water diversion device of a mounting bracket embodying the present invention.

A water diversion device 105 catches water shedding off of the siding generally at the top of the mounting bracket 50 and diverts the flow outward and away from the underlayment. Referring to FIG. 2, the water diversion device 105 preferably has an eave 107 and a lower trough 108. Preferably, both the eave 107 and the trough 108 have respective end dams 110, 112 that directs water flow. Water flowing into the eave 107 cascades into the trough 108 where it is preferably directed through first and second holes 114, 116 of the device 105 in the trim flange 68.

The eave 107 has an elongated shelf 118 having opposite ends attached to the respective end dams 110 and a chamfered backsplash 120 that extends longitudinally with the shelf 118 and generally connects with the end dams 110. As best illustrated in FIG. 3, the backsplash 120 of the eave 107 is preferably secured to the top portion 88 of the flange 58 via an adhesive or is injection molded as one unitary plastic piece. If the eave 107 and the base member 52 are one piece, an inward face 122 of the flange 58 may generally act as the backsplash 120. The trough 108 has an elongated bottom segment 124 having opposite ends attached to the respective end dams 112 and an elongated lip 126 that projects laterally upward from and extends longitudinally with the bottom segment 124 and generally connects sealably to the end dams 112. A forward longitudinal edge 128 of the bottom segment 124 is preferably connected to the top portion 104 of the trim flange 68 via a water resistant adhesive. Alternatively, the bottom segment 124 can be integrated into the top partition 96 of the partition arrangement 66 if the trough 108 and the trim member 54 are injection molded as one unitary plastic piece. In either case, the trough 108 carries a generally concave face 130 that defines a water channel 132 that is generally open upward for receipt of water dropping from the eave 107. Water entering the channel 132 then flows out through the communicating holes 114, 116.

The substantially horizontal distance between holes 114, 116 is preferably greater than the distance 82 measured between the side walls 74, 76 of the wall arrangement 62, and preferably less than a horizontal width or distance 139 of the base flange 58. In order for the holes 114, 116 to communicate directly with the channel 132 of the trough 108, the distance between the end dams 112 is greater than the distance between the holes 114, 116. For mounting bracket applications that can adjust to varying thicknesses of siding, such as that disclosed in U.S. Pat. No. 5,918,431 assigned to the assignee of the present invention and incorporated herein by reference in it's entirety, the horizontal or lateral width of the trough 108 generally represents the minimum thickness of siding compatible with the mounting bracket 50 (see FIG. 8). Moreover, the width of the eave 107 is less than the width of the trough 108 to assure that the eave 107 does not abut against the trim flange 68 which would undesirable restrict water flow when a minimum siding thickness is applied. However, the width of the eave 107 is large enough to handle the thickness range of siding that the bracket 50 is compatible with. That is, the width of the eave 107 represents the difference in thickness between the maximum and minimum siding thicknesses that the bracket 50 can generally handle with the assembled outcome being the trim flange 68 being substantially flush with an exterior surface of the siding.

During construction of the building and with the sheathing on the exterior wall, the flange 58 of the base member 52 is preferably nailed to the sheathing. The siding material is then installed over the wall and over the base flange 28. The siding, however, must be trimmed or cut to create a gap between the cut ends and the side walls 74, 76 of the continuous wall 62 of the base member 52. This gap allows room for entry of the side partitions 92, 94 of the continuous partition arrangement 66 of the trim member 54, yet is close enough to the wall so that the cut ends are aesthetically concealed by the outer flange 68 of the trim member 54 which is substantially flush to the siding. Similarly, the siding must be appropriately trimmed to cover a portion of the top portion 88 of the base flange 58 but clear enough from the top wall 78 to permit space for the protruding eave 107.

When fully assembled, water drips off of the siding located above the eave 107 and falls into the eave. From there, the water falls into the trough 108 and out the holes 114, 116. After flowing from the holes, the water drips down the exterior face of the left and right side portions 102, 104 of the trim flange 68 where it then sheds upon the exterior face of the siding below or simple falls to the ground clear of the sheathing.

As best illustrated in FIGS. 9-12, a second embodiment of the mounting bracket 50' is illustrated wherein like elements have like identifying numerals except with the addition of a prime symbol. In the second embodiment, the eave 107 of the first embodiment is not required. Instead, the mounting bracket 50' has a trough 108' of a water diversion device 105' having a resiliently flexible lip 126' that is biased against a top portion 88' of a base flange 58' of a base member (not shown). Preferably, the trim member 54' and a portion of the trough 108' is made of injection molded plastic and the lip 126' is a rubber like material either press fitted to the plastic portion of the trough 108' or is formed to the trim member 54' during a dual injection manufacturing process generally known in the art. Preferably, the lip 126' projects from a shelf 124' at an angle directed in an upward and inward direction. The width or projection of the lip 126' is sufficiently large to accommodate a range of siding thicknesses.

As best illustrated in FIGS. 13-16, a third embodiment of the mounting bracket 50" is illustrated wherein like elements have like identifying numerals except with the addition of a double prime symbol. In this third embodiment, the holes 114, 116 of the first embodiment are not in the top portion 104" of the trim flange 68" and instead holes 114", 116" are placed in a bottom segment 124" of a trough 108" of a water diversion device 105". Preferably, the holes 114", 116" are located at respective ends of the trough 108" and generally skewed toward the trim flange 68" as oppose to a base flange (not shown). The holes 114", 116" each communicate with respective passages 146 defined by substantially vertical drainage tubes 142, 144 connected to and generally draping down from the bottom segment 124" thus forming an inverted U-shape. A channel 132" of the trough 108" is generally defined by two opposing dam ends 112", a longitudinal first lip 126" and a longitudinal second lip 140 disposed opposite the first lip 126".

In this third embodiment of bracket 50" the trim flange 68" is preferably not generally flush with the siding. Instead, an outer peripheral rim 148 projects axially inward from the trim flange 68" and at a distance to at least partially accommodate the tubes 142, 144. That is, when the bracket 50" is fully assembly, the siding is generally disposed between the base flange of a base member (not shown) and the tubes 142, 144, and the tubes are generally layered between the left and right portions of the trim flange 68" and the siding near the cut ends of the siding. Preferably, two notches 150 are cut out from a bottom portion of the rim 148 to permit passage of the distal ends of the respective tubes 142, 144.

During assembly of bracket 50", the inverted U-shaped trough 108" and tubes 142, 144 can be draped over the partition arrangement of the trim member 54" as a third piece of the bracket 50". Alternatively, portions or all of the trough 108" and tubes 142, 144 can be integrated or molded into the adjacent trim flange and partition arrangement of the trim member 54".

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that reference numerals are utilized merely for convenience and are not to be limiting in any way, and that the invention may be practiced otherwise than as specifically described.

What is claimed is:

1. An exterior siding mounting bracket secured to substructure and orientated substantially vertical and in-part generally projecting over siding that covers the substructure, the exterior siding mounting bracket comprising:

a base member attached to the substructure and having at least one elongated wall projecting laterally outward from the substructure;

a trim member having an outer flange with the siding disposed between the substructure and the outer flange, an elongated first side partition and an elongated second side partition spaced from the first side partition by a first distance, and wherein the first and second side partitions project laterally inward with respect to the substructure and from the outer flange for snap fitting to the at least one elongated wall;

a water diversion device having a trough located above the first and second side partitions, supported by the outer flange and projecting laterally toward the substructure for receiving and diverting water run-off away from the substructure, at least one hole of the water diversion device extending through the outer flange for flowing water out of the trough.

2. The exterior siding mounting bracket set forth in claim 1 wherein the trough has a longitudinal second distance that is greater the first distance and less than a width of the trim member.

3. The exterior siding mounting bracket set forth in claim 1 further comprising:

a first side portion of the outer flange connected to the first side partition;

a second side portion of the outer flange connected to the second side partition;

a top portion of the outer flange extending between upper ends of the first and second side portions and supporting the trough.

4. The exterior siding mounting bracket set forth in claim 3 wherein water draining from the at least one hole travels down at least one of the first and second side portions.

5. The exterior siding mounting bracket set forth in claim 1 further comprising:

a concave face of the trough defining a cavity opened upwardly and communicating with the at least one hole; and wherein the face is carried in-part by the outer flange.

6. The exterior siding mounting bracket set forth in claim 5 further comprising first and second end dams of the trough carrying in part the concave face.

7. The exterior siding mounting bracket set forth in claim 6 further comprising an elongated eave of the water diversion device projecting laterally outward from the base member and disposed above the trough for drainage of water into the trough.

8. The exterior siding mounting bracket set forth in claim 7 further comprising:

a shelf of the eave extending substantially horizontally and projecting lateral outward from the base; and two opposite end dams of the eave engaged between the base member and the ends of the shelf for channeling water.

9. The exterior siding mounting bracket set forth in claim 8 wherein the eave is formed unitarily to the base member as one injection molded plastic piece.

10. The exterior siding mounting bracket set forth in claim 8 wherein the trough is formed unitarily to the trim member as one injection molded plastic piece.

11. An exterior siding mounting bracket secured to substructure orientated substantially vertical and generally projecting in-part over siding that covers the substructure, the exterior siding mounting bracket comprising:

a base member having a base flange fastened to the substructure, a wall arrangement projecting laterally outward from the flange;

a trim member attachable to the base member and having a trim flange disposed over the siding and a partition arrangement projecting laterally inward from the trim flange;

a water diversion device having a trough disposed substantially horizontally and defining a channel opened upward for receipt of shedding water between the base flange and the trim flange and at least one hole communicating through an upward face of the trough for drainage flow of water from the channel; and the partition arrangement having a top partition defining in part a lower opening in the trim member and carrying in part the upward face of the trough, at least one hole of the water diversion device extending through the outer flange for flowing water out of the trough.

12. The exterior siding mounting bracket set forth in claim 11 wherein the trough has a resilient flexible and longitudinally extending lip biased sealably against a top portion of the base flange for diverting water into the channel and through the at least one hole.

13. The exterior siding mounting bracket set forth in claim 11 further comprising an eave projecting laterally outward from the base flange and disposed above the trough for shedding water into the channel.

14. The exterior siding mounting bracket set forth in claim 13 wherein the eave and the trough are substantially horizontal and extend longitudinally by a distance that is greater than a horizontal width of the partition arrangement.

15. The exterior siding mounting bracket set forth in claim 14 wherein a width of the trough is greater than a width of the eave.

* * * * *

UNITED STATES PATENT AND TRADEMARK OFFICE

CERTIFICATE OF CORRECTION

PATENT NO. : 7,516,578 B2
APPLICATION NO. : 11/438165
DATED : April 14, 2009
INVENTOR(S) : Dave Bonshor It is certified that error appears in the above-identified patent and that said Letters Patent is hereby corrected as shown below:

In Column 7, Line 24 Claim 8, please insert --member-- between “base” and “;”

Signed and Sealed this

Twenty-third Day of June, 2009

JOHN DOLL
*Acting Director of the United States Patent and Trademark Office*